US008419007B2

(12) United States Patent
Iijima

(10) Patent No.: US 8,419,007 B2
(45) Date of Patent: Apr. 16, 2013

(54) IMAGE RECORDING DEVICE

(75) Inventor: Shota Iijima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/244,002

(22) Filed: Sep. 23, 2011

(65) Prior Publication Data

US 2012/0161380 A1 Jun. 28, 2012

(30) Foreign Application Priority Data

Dec. 28, 2010 (JP) ..... 2010-292794

(51) Int. Cl.
*B65H 5/22* (2006.01)
*B65H 5/00* (2006.01)

(52) U.S. Cl.
USPC ..... 271/3.14; 271/225; 271/186; 271/117; 399/401

(58) Field of Classification Search ..... 271/3.14, 271/225, 186, 117, 272–274; 399/401
See application file for complete search history.

(56) References Cited

U.S. PATENT DOCUMENTS

| | | | | |
|---|---|---|---|---|
| 6,909,872 | B2 * | 6/2005 | Eskey | 399/401 |
| 7,258,335 | B2 * | 8/2007 | Johnson et al. | 271/10.01 |
| 8,152,161 | B2 * | 4/2012 | Samoto et al. | 271/186 |
| 8,240,655 | B2 * | 8/2012 | Samoto et al. | 271/3.19 |
| 2011/0291347 | A1 * | 12/2011 | Sano et al. | 271/3.19 |
| 2011/0310206 | A1 * | 12/2011 | Samoto et al. | 347/104 |

FOREIGN PATENT DOCUMENTS

| | | | |
|---|---|---|---|
| JP | H07-277552 | A | 10/1995 |
| JP | 2006-062808 | A | 3/2006 |
| JP | 2006-062809 | A | 3/2006 |

* cited by examiner

*Primary Examiner* — Luis A Gonzales
(74) *Attorney, Agent, or Firm* — Baker Botts L.L.P.

(57) ABSTRACT

An image recording device includes a first arm configured to pivot between a first position and a second position in response to mounting and removal of a tray to and from the image recording device, a first driving roller attached to an end of the first arm and configured to convey a sheet from the tray toward a first conveying path, a recording unit configured to record an image on the sheet conveyed along the first conveying path, a second arm configured to pivot between a third position and a fourth position, and a second driving roller attached to an end of the second arm and configured to convey the sheet having an image recorded on one side thereof, along a second conveying path toward the first conveying path. The second arm pivots from the third position to the fourth position when the first arm pivots from the first position to the second position.

12 Claims, 7 Drawing Sheets

IMAGE RECORDING DEVICE

CROSS REFERENCE TO RELATED APPLICATION

This application claims priority from Japanese Patent Application No. 2010-292794, which was filed on Dec. 28, 2010, the disclosure of which is incorporated herein by reference in its entirety.

BACKGROUND OF THE INVENTION

1. Field of the Invention

This application relates to an image recording device configured to record an image on a sheet, and particularly to an image recording device configured to record an image on both sides of a sheet.

2. Description of Related Art

A known image recording device is configured to record an image on both sides of a recording medium, e.g., a sheet, and comprises a recording unit disposed above a tray. In such an image recording device, a sheet fed from the tray is conveyed by a first roller pair to the recording unit disposed above the tray, and the recording unit records an image on one side of the sheet. The sheet is switched back by a second roller pair disposed downstream of the recording unit and is conveyed to a return path formed between the recording unit and the feed tray. The sheet is conveyed by a third roller pair disposed in the return path to the first roller pair which conveys the sheet to the recording unit. The recording unit records an image on the other side of the sheet. The sheet having images on both sides thereof is discharged by the second roller pair.

Another known image recording device comprises a return unit for returning a sheet, along a return path, to a recording unit for double-sided image recording after the recording unit records an image on one side of the sheet. A roller pair in the return unit pinches the sheet and conveys the sheet again toward the recording unit. By removing a sheet feed tray from a housing and by operating a release lever, a guide defining the return path is opened such that a pinching state between the roller pair is released.

SUMMARY OF THE INVENTION

It may be beneficial to simplify, in an image recording device, handling of a sheet if jammed in a return path for double-sided image recording.

According to an embodiment of the invention, an image recording device comprises a first conveying path along which a sheet is conveyed in a first conveying direction, a recording unit configured to record an image on the sheet conveyed along the first conveying path, a tray configured to hold the sheet and to be removably mounted in a housing of the image recording device at a position below the recording unit, a first driving roller configured to convey the sheet from the tray in a second conveying direction toward the first conveying path, a first arm having an end to which the first driving roller is rotatably attached, a second conveying path formed below the recording unit and above the tray, a second driving roller configured to convey the sheet along the second conveying path in a third conveying direction, and a second arm having an end to which the second driving roller is rotatably attached. The first arm is configured to pivot between a first position and a second position, about a pivot axis located on an opposite side of the first arm from the first driving roller in the second conveying direction. The first arm is in the first position when the tray is mounted in the housing, and is in the second position when the tray is removed from the housing. The second conveying path extends from a position downstream of the recording unit in the first conveying direction to a position upstream of the recording unit in the first conveying direction. The second arm is configured to pivot between a third position and a fourth position, about a pivot axis located on an opposite side of the second arm from the second driving roller in the third conveying direction. The second arm pivots from the third position to the fourth position when the first arm pivots from the first position to the second position.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-7, like numerals being used for like corresponding parts in the various drawings.

Figure 1:
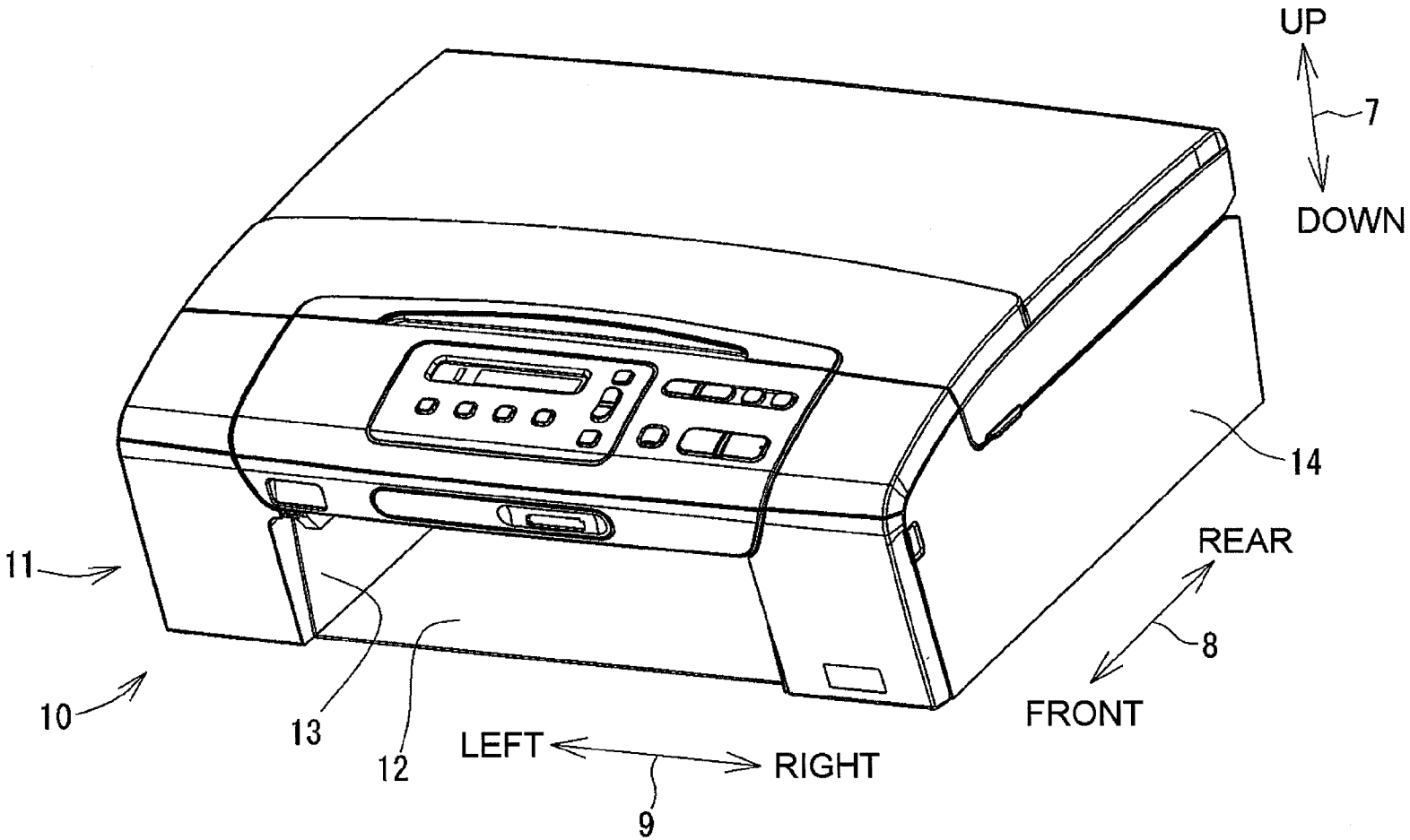
FIG. 1 is a perspective view of an image recording device, e.g., a multi-function device, according to an embodiment of the invention.

In the following description, the expressions "front", "rear", "upper", "lower", "right", and "left" are used to define the various parts when an image recording device, e.g., a multi-function device 10, is disposed in an orientation in which it is intended to be used. As shown in FIG. 1, double-headed arrows 7, 8, 9 indicate up-to-down, front-to-rear, and right-to-left directions, respectively.

As shown in FIG. 1, the multi-function device 10 has a flat box shape and comprises, at a lower portion thereof, a printer 11 of an inkjet type. The printer 11 may perform recording on both sides of a sheet. The multi-function device 10 may perform one or more functions, e.g., printing, copying, scanning, facsimile functions, or any combination thereof.

The printer 11 comprises a housing 14 having an opening 13 at the front of the multi-function device 10. A tray 20 for holding various sizes of recording media, e.g., sheets, is disposed on a bottom plate 12 of the printer 11. The tray 20 is inserted into and withdrawal from the housing 14 through the opening 13 in the front-to-rear direction 8 by a sliding mechanism. The sliding mechanism is, for example, rails provided on both sides of the housing 14 or provided on the bottom plate 12, to extend from the opening 13. The tray 20 is mounted into and removed from the multi-function device 10.

Figure 2:
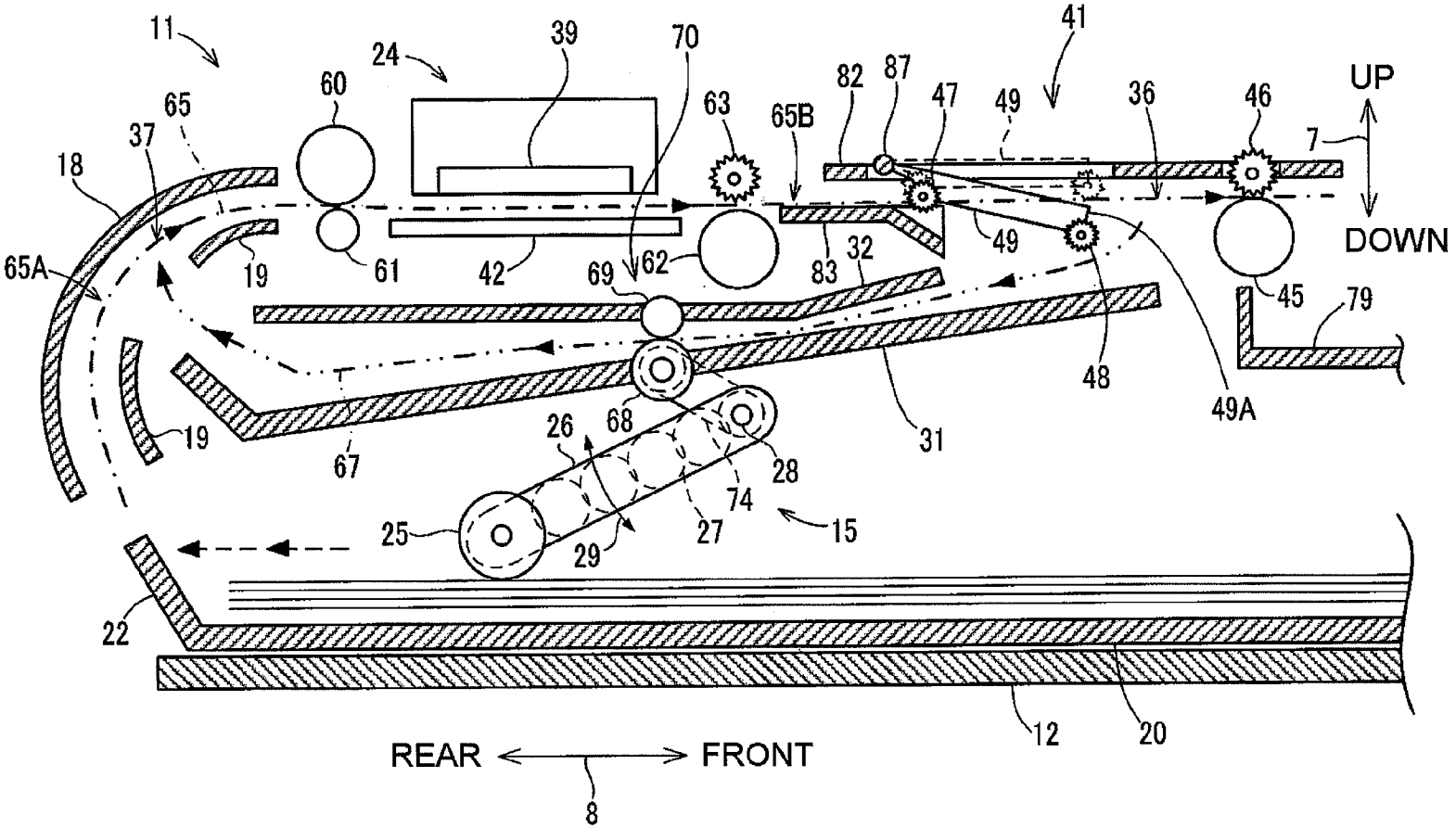
FIG. 2 is a schematic vertical cross-sectional side view of a printer of the image recording device of FIG. 1.

As shown in FIG. 2, the printer 11 comprises a sheet feeder 15, a recording unit 24 of an inkjet type, and a path switching unit 41. The sheet feeder 15 picks up a sheet in the tray 20 and feeds the sheet from the tray 20. The recording unit 24 ejects ink droplets onto the sheet fed by the sheet feeder 15 to record an image on the sheet. Alternatively, the recording unit 24 may be of an electrophotographic type or other types.

Figure 3:
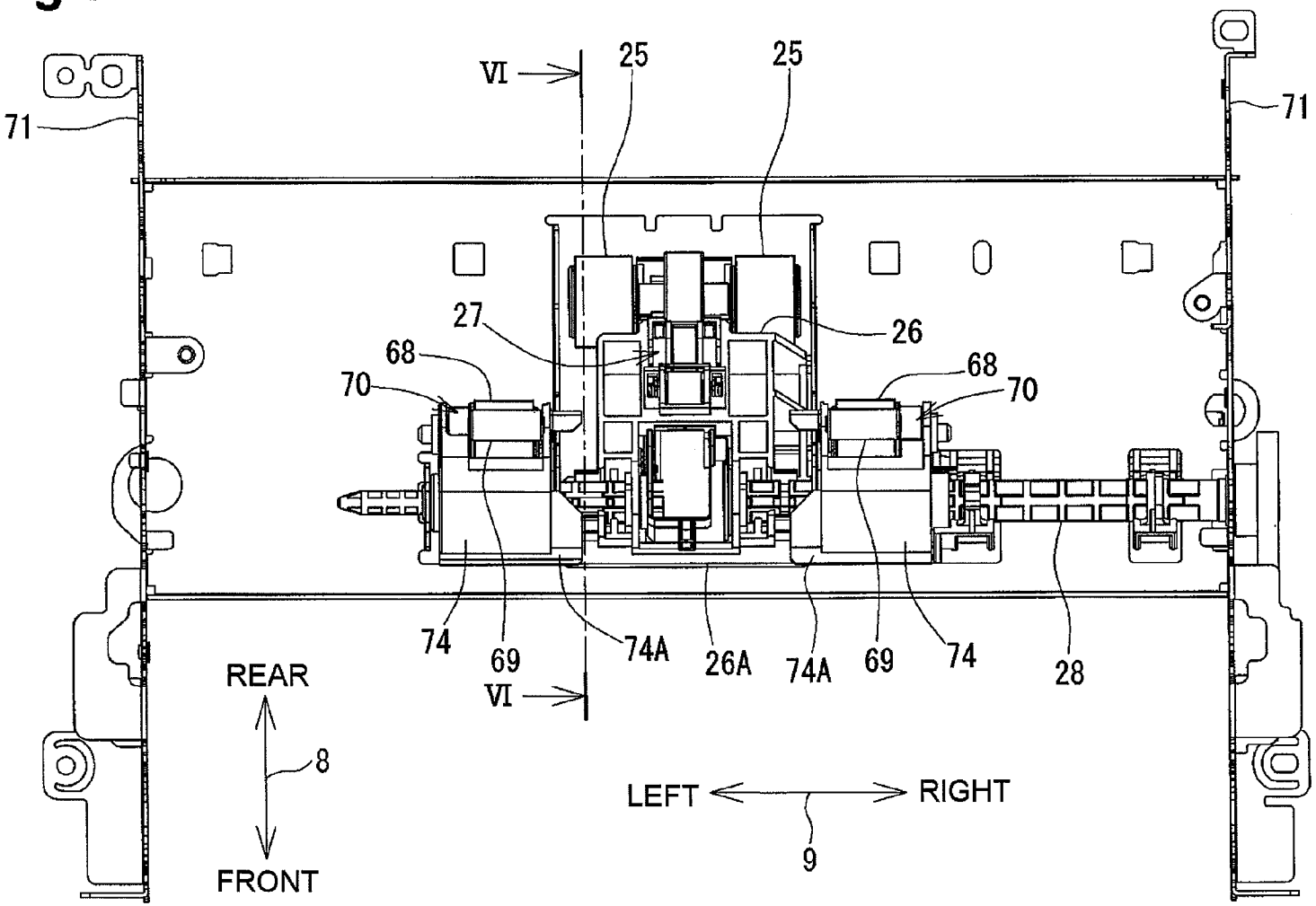
FIG. 3 is a plan view showing a structure of surrounding components of a sheet feeder of the printer of FIG. 2.
Figure 4:
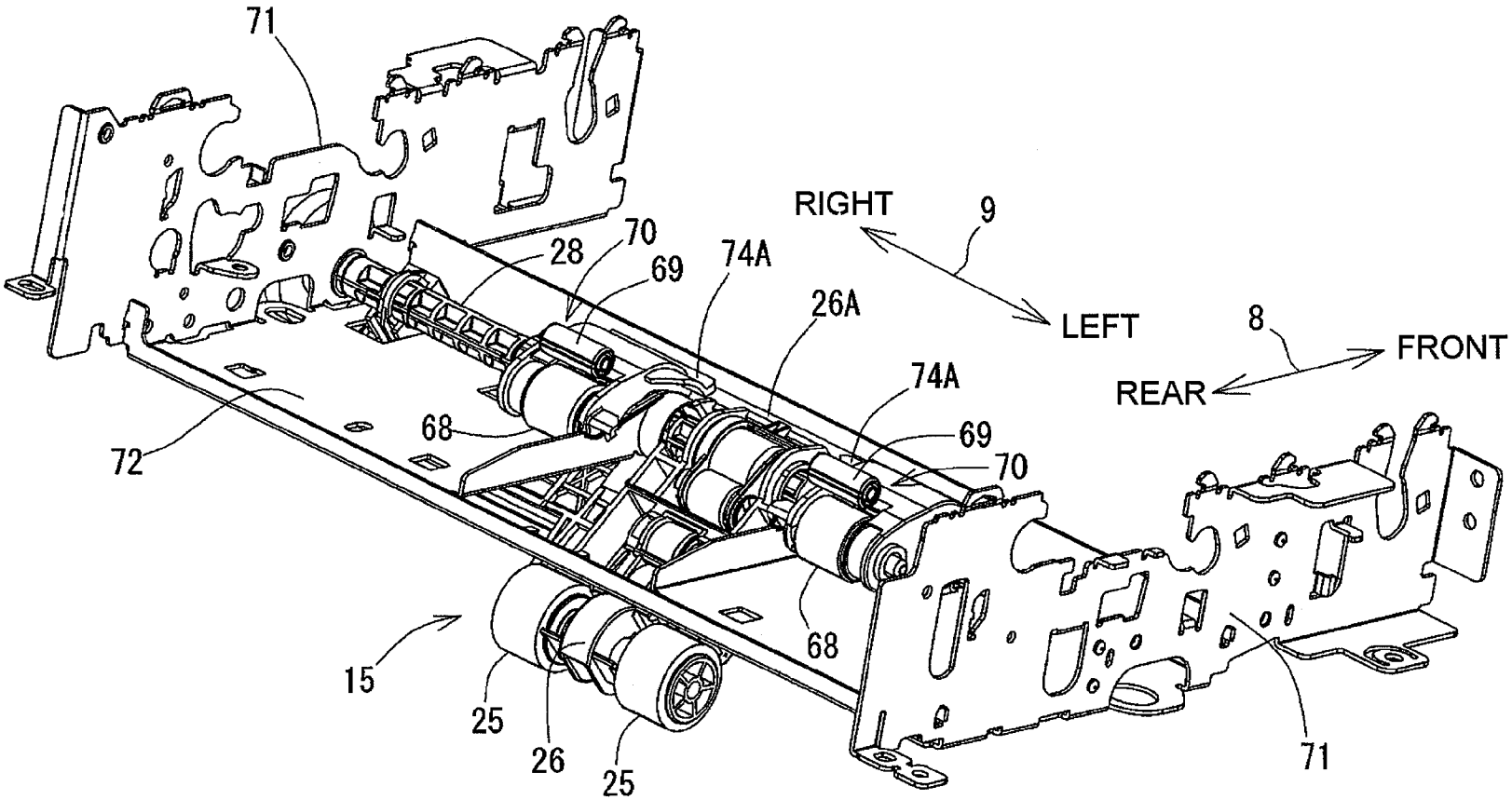
FIG. 4 is a perspective view showing a structure of the surrounding components of the sheet feeder.

As shown in FIG. 2, a sheet feeder 15 is disposed above the tray 20 and below the recording unit 24. The sheet feeder 15 comprises a first driving roller, e.g., feed rollers 25, a first arm, e.g., a feed arm 26, and a shaft 28, and a driving force transmitting mechanism 27. As shown in FIGS. 3 and 4, the printer 11 comprises a pair of side frames 71 spaced apart from each other in the right-to-left direction 9, and a base frame 72 disposed between the side frames 71. The shaft 28 is rotatably supported by the base frame 72.

As shown in FIG. 2, the feed arm 26 is attached to the shaft 28. A base end (front end) of the feed arm 26 is rotatably supported by the shaft 28, and the feed arm 26 extends from the shaft 28 obliquely rearward and downward. The feed arm 26 is pivotable about the shaft 28 in directions of arrows 29. The feed arm 26 is configured to pivot between a first position shown in FIG. 6 and a second position shown in FIG. 7. When the feed arm 26 is in the first position, the feed rollers 25 are in contact with an upper surface of the tray 20 or an upper surface of the sheets held on the tray 20 while the tray 20 is mounted in the printer 11. That is, when the feed arm 26 is in the first position, the feed rollers 25 are in positions for conveying the sheets. When the feed arm 26 is in the second position, the feed rollers 25 are in contact with the bottom plate 12 positioned below a mounting position of the tray 20 while the tray 20 is removed from the printer 11. That is, when the feed arm 26 is in the second position, the feed rollers 26 are below the conveying positions.

Figure 5:
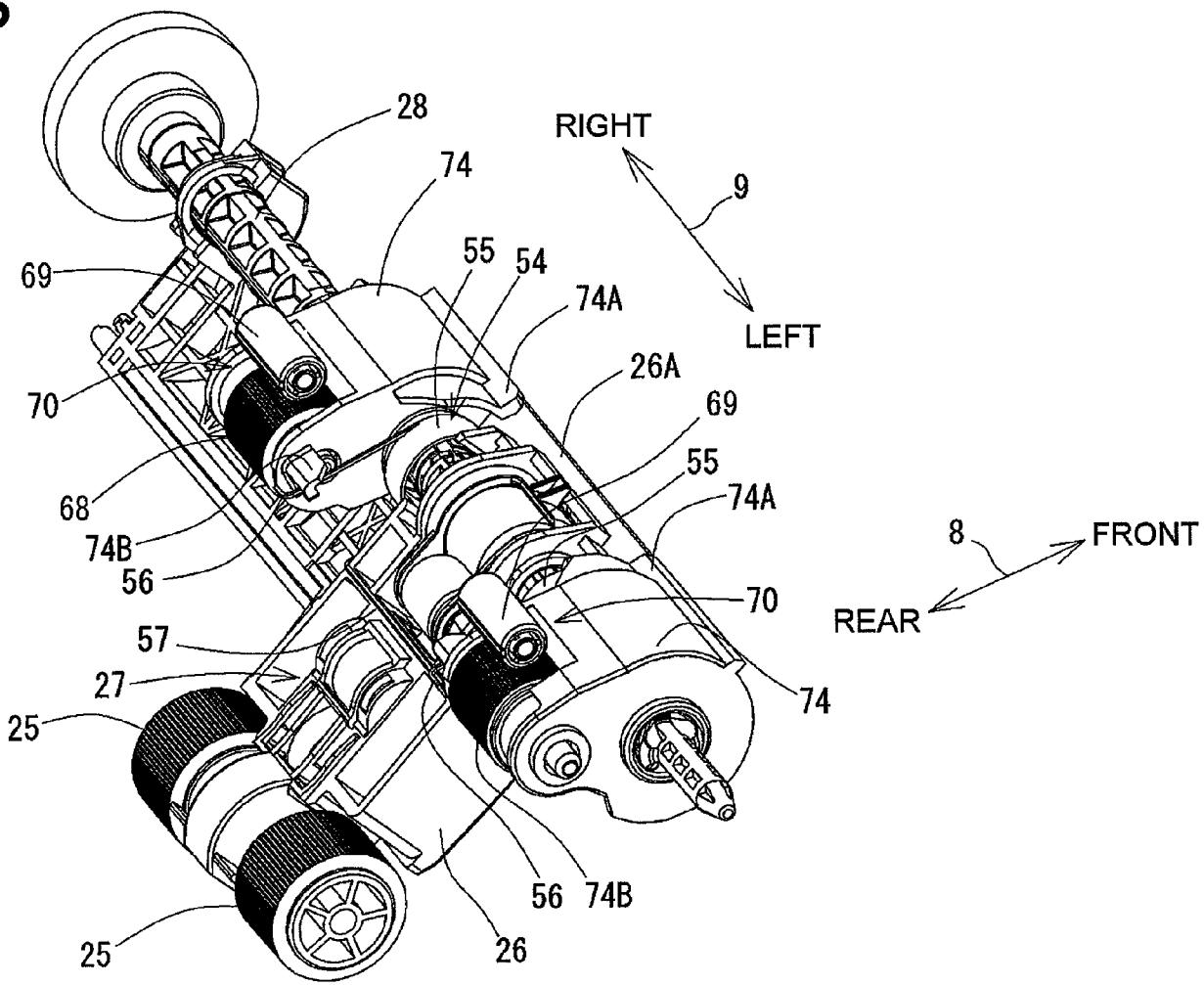
FIG. 5 is an enlarged perspective view showing a structure of the sheet feeder.

As shown in FIG. 5, the two feed rollers 25 are disposed at a free end of the feed arm 26. Thus, the feed rollers 25 are disposed behind the shaft 28. In other words, the shaft 28 is disposed in front of the feed rollers 25. The shaft 28 is disposed on an opposite side of the feed arm 26 from the feed rollers 25 in a second conveying direction, which will be described later. The two feed rollers 25 are spaced apart from each other in the right-to-left direction and are rotatably supported by the free end of the feed arm 26.

With the above-described structure, the feed rollers 25 make contact with and move away from the upper surface of the sheets held on the tray 20 as the feed arm 26 pivots. The driving force transmitting mechanism 27 is disposed in the feed arm 26 and comprises a plurality of gears meshed with each other. The driving force transmitting mechanism 27 transmits a driving force of a sheet feed motor (not shown) to the feed rollers 25 so that the feed rollers 25 rotate. When the feed rollers 25 rotate while contacting a topmost one of the sheets held on the tray 20 mounted in the printer 11, the feed rollers 25 separate the topmost sheet from the remaining sheets and feed the topmost sheet in the second conveying direction. The second conveying direction is a direction away from the tray 20 toward the curved path 65A, and is shown by a broken line with arrows in FIG. 2.

As shown in FIG. 5, the feed arm 26 comprises, a first engaging member, e.g., a projecting member 26A, disposed at an end portion thereof adjacent to the shaft 28. The projecting member 26A extends in the right-to-left direction 9. The projecting member 26A projects from the shaft 28 in a direction opposite from the feed rollers 25. Opposed ends of the projecting member 26A in the right-to-left direction 9 extend to positions below engaging members 74A of convey arms 74, respectively. The engaging members 74A are each an example of a second engaging member. When the feed arm 26 pivots in a predetermined direction (counterclockwise direction in FIG. 2), the projecting member 26A pushes up the engaging members 74A and pivots the convey arms 74 in the predetermined direction (counterclockwise direction in FIG. 2).

As shown in FIG. 2, a first conveying path, e.g., a conveying path 65, is formed in the printer 11 and extends from a rear end of the tray 20, via the recording unit 24, to a sheet receiver 79. The conveying path 65 is divided into a curved path 65A extending from the rear end of the tray 20 to the recording unit 24, and a discharging path 65B extending from the recording unit 24 to the sheet receiver 79.

The curved path 65A is a curved path extending from a position near an upper end of an inclined plate 22 disposed on the tray 20. The curved path 65A has a shape of substantially an arc with a center located on an inner side of the printer 11. The sheet fed from the tray 20 to the curved path 65A is guided by the curved path 65A in a first conveying direction. The first conveying direction is a direction away from the inclined plate 22, via the recording unit 24, toward the sheet receiver 79, and is shown by a one-dot-one-dash line with arrows in FIG. 2. The curved path 65A is defined by an outer guide 18 and an inner guide 19 that are opposed to each other with an interval therebetween. The outer guide 18, the inner guide 19, and other guides 82, 83, 31, 32, which will be described later, extend in a direction perpendicular to drawing sheet plane of FIG. 2 (in the right-to-left direction 9).

The discharging path 65B is a linear path extending from a position right below the recording unit 24 to the sheet receiver 79. The sheet is guided along the discharging path 65B in the first conveying direction. The discharging path 65B is defined by the recording unit 24 and a platen 42 that are opposed to each other with an interval therebetween and by an upper guide 82 and a lower guide 83 that are opposed to each other with an interval therebetween.

A branch position 36 is defined on a downstream side of the recording unit 24 in the first conveying direction. The sheet is switched back on a downstream side of the branch position 36 and is directed toward a second conveying path, e.g., a return path 67, extending rearward from the branch position 36.

The recording unit 24 is disposed above the tray 20 and reciprocates in the right-to-left direction 9 (in a direction perpendicular to the drawing sheet plane of FIG. 2). The platen 42 is disposed below the recording unit 24 to support the sheet horizontally. The recording unit 24 ejects from nozzles 39 ink, which is supplied from an ink cartridge (not shown), onto the sheet conveyed on the platen 42, and records an image on the sheet.

As shown in FIG. 2, a first convey roller 60 and a pinch roller 61 are disposed between each of downstream ends of the outer guide 18 and the inner guide 19, and the recording unit 24. The pinch roller 61 is disposed below the first convey roller 60 and is pressed against a roller surface of the first convey roller 60 by an elastic member (not shown), e.g., a spring. The first convey roller 60 and the pinch roller 61 pinch the sheet conveyed along the curved path 65A and convey the sheet onto the platen 42.

A second convey roller 62 and a spur roller 63 are disposed between the recording unit 24 and each of the upper guide 82 and the lower guide 83. The spur roller 63 is disposed above the second convey roller 62 and is pressed against a roller surface of the second convey roller 62 by an elastic member (not shown), e.g., a spring. The second convey roller 62 and the spur roller 63 pinch the sheet having an image recorded thereon by the recording unit 24 and convey the sheet downstream in the first conveying direction toward the sheet receiver 79.

The first convey roller 60 and the second convey roller 62 rotate by being driven by a sheet convey motor (not shown) via a transmission mechanism (not shown). The transmission mechanism comprises a planet gear and the like and transmits a driving force from the sheet convey motor so as to rotate the covey rollers 60, 62 in a single rotating direction regardless of whether the convey motor rotates in a forward direction or in a reverse direction. Accordingly, the sheet is conveyed in the first conveying direction.

A third convey roller 45 and a spur roller 46 are disposed in a downstream side of the branch position 36 in the first conveying direction. The spur roller 46 is disposed above the third conveying roller 45 and is pressed against a roller surface of the third convey roller 45 by an elastic member (not shown), e.g., a spring.

A driving force of the sheet convey motor which rotate in the forward direction or in the reverse direction is transmitted to the third covey roller 45 such that the third convey roller 45 rotates either in a forward direction or in a reverse direction. The third convey roller 45 may be configured to rotate in the forward direction when the printer 11 records on a single side of the sheet. In this case, the third convey roller 45 and the spur roller 46 convey the sheet downstream and discharge the sheet onto the sheet receiver 79. When the printer 11 records on both sides of the sheet, the rotation direction of the third convey roller 45 may be reversed into the reverse direction while a trailing edge of the sheet is pinched by the rollers 45, 46. Accordingly, the sheet is conveyed in a direction opposite to the first conveying direction, and is conveyed by the path switching unit 41 toward the return path 47.

As shown in FIG. 2, the path switching unit 41 is disposed on a downstream side of the second convey roller 62 in the first conveying direction and on an upstream side of the branch position in the first conveying direction. The path switching unit 41 comprises an auxiliary roller 47, an auxiliary roller 48, a flap 49, and a shaft 87.

The shaft 87 is disposed on a frame or the like of the printer 11 and extends in a direction perpendicular to the drawing sheet plane of FIG. 2 (in the right-to-left direction 9 in FIG. 1). The flap 49 extends from the shaft 87 toward a downstream side in the first conveying direction and is pivotably supported by the shaft 87. The auxiliary rollers 47, 48 are rotatably supported by the flap 49. The auxiliary rollers 47, 48, which contact an image-recorded surface of the sheet, are formed similarly to the spur rollers 63, 46.

The flap 49 is configured to pivot between a discharge position (shown by a broken line in FIG. 2) above the lower guide 83 and a reverse position (shown by a solid line in FIG. 2) in which a free end 49A is below the branch position 36. When the flap 49 is in the discharge position, the sheet having passed the recording unit 24 is conveyed downstream in the first conveying direction. When the flap 49 is in the reverse position, the sheet having passed the recording unit 24 is switched back and conveyed along the return path 67.

As shown in FIG. 2, the return path 67 is formed below the recording unit 24 and above the tray 20. The return path 67 branches from the discharging path 65B at the branch position 36, extends below the recording unit 24 and above the feed arm 26, and merges with the curved path 65A at a merge position 37. The sheet is conveyed along the return path 67 in a third conveying direction. The third conveying direction is a direction away from the branch position 36 toward the merge position 37, and is shown by a two-dot-one-dash line with arrows in FIG. 2.

The return path 67 is defined, from above, by the second guide 32 having substantially a flat rectangular shape, and defined, from below, by the first guide 31 having substantially a flat rectangular shape. Specifically, the return path 67 is defined by a lower surface of the second guide 32 and an upper surface of the first guide 31. The second guide 32 and the first guide 31 are opposed to each other with an interval therebetween such that the sheet passes the interval. Opposed ends of the second guide 32 and the first guide 31 are supported by the frame or the like of the printer 11.

As shown in FIG. 2, a roller pair 70 is disposed along the return path 67. The roller pair 70 comprises a second driving roller, e.g., a fourth convey roller 68, and a driven roller 69. In this embodiment, as shown in FIGS. 3 and 4, two driven rollers 69 are provided so as to be spaced apart from each other by a predetermined distance in the right-to-left direction 9. The driven rollers 69 are rotatably supported by the second guide 32 or a frame (not shown). The two driven rollers 69 are disposed at positions opposed to two fourth convey rollers 68, respectively, as will be described later. A structure for supporting the driven rollers 69 is omitted from FIGS. 3 to 5 for convenience of description, and only the driven rollers 69 are shown.

As shown in FIG. 2, the fourth convey roller 68 is disposed at a position below and opposed to the corresponding driven roller 69. The fourth convey rollers 68 and the first guide 31 are disposed on the same side of the return path 67. In this embodiment, as shown in FIGS. 3 and 4, the two fourth convey rollers 68 are provided. The fourth convey rollers 68 are rotatably supported by free ends of the convey arms 74, as will be described later. A driving force of the sheet convey motor (not shown) which rotates in the forward direction or the reverse direction is transmitted to the fourth covey roller 68 such that the fourth convey roller 68 rotates either in a forward direction or in a reverse direction. In this embodiment, when the sheet convey motor rotates in the reverse direction, the fourth convey roller 68 and the driven roller 69 of each roller pair 70 pinch the sheet conveyed along the return path 67 and convey the sheet in the third conveying direction.

As shown in FIG. 5, the covey arms 74 are attached to the shaft 28. One of the convey arms 74 is an example of a second arm, and the other of the convey arms 74 is an example of a third arm. A base end portion (front end portion) of each convey arm 74 is supported by the shaft 28. The shaft 28 supports the feed arm 26 and the convey arms 74 such that the arms 26, 27 are pivotable. Accordingly, the convey arms 74 are pivotable about the shaft 28. The two convey arms 74 are spaced apart from each other by a predetermined distance in an axial direction of the shaft 28 (in the right-to-left direction 9). Specifically, the convey arms 74 are disposed on both sides of the base end portion of the feed arm 26 so as to sandwich the feed arm 26 in the right-to-left direction 9. The feed arm 26 is disposed between the two convey arms 74. Although, in this embodiment, the feed arm 26 and the convey arms 74 are configured to pivot about the single common shaft 28, the feed arm 26 and the convey arms 74 may pivot about different shafts.

Figure 6:
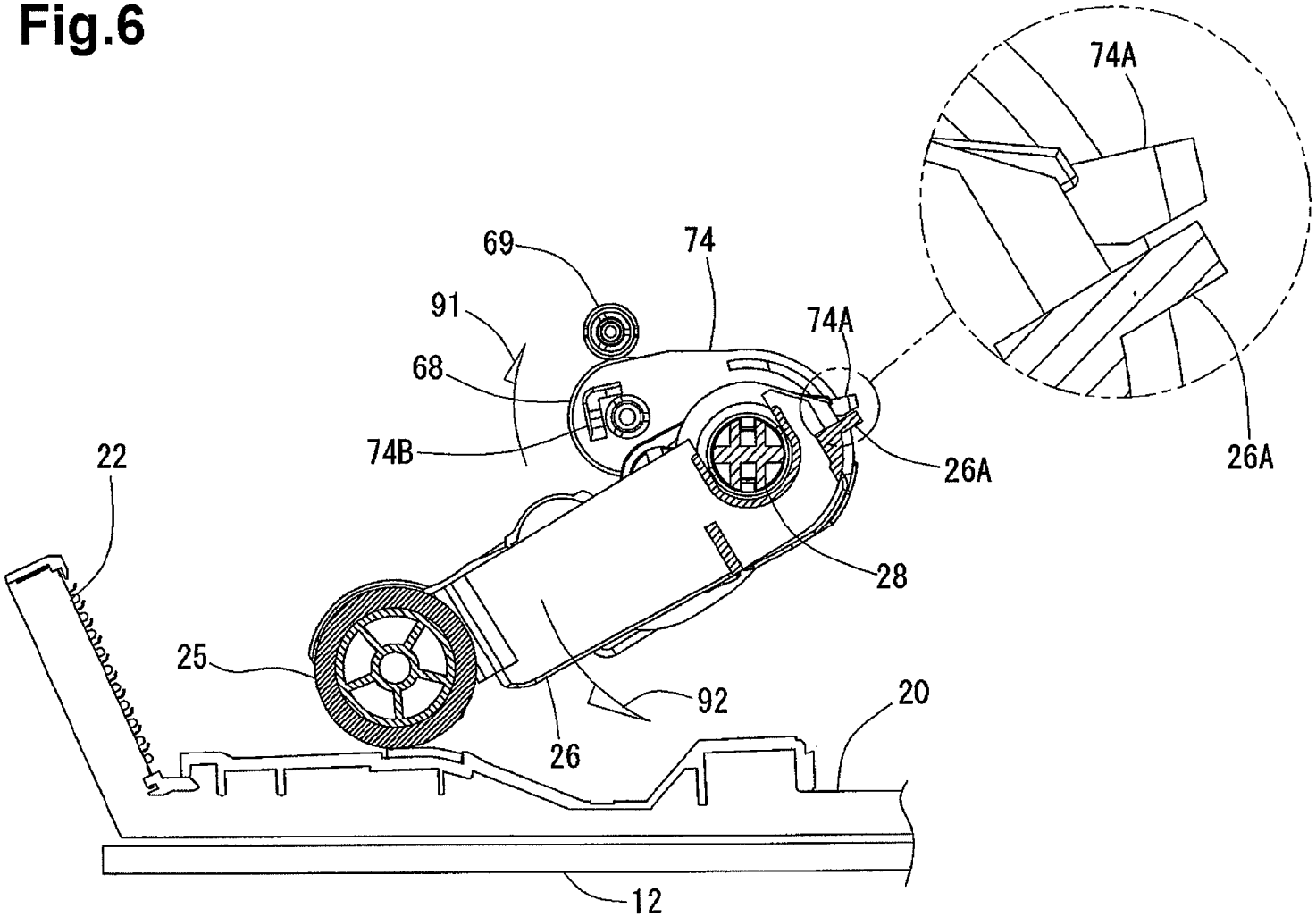
FIG. 6 is a partial cross-sectional view taken along line VI-VI of FIG. 3, showing a feed arm and a convey arm when a tray is mounted in a housing.
Figure 7:
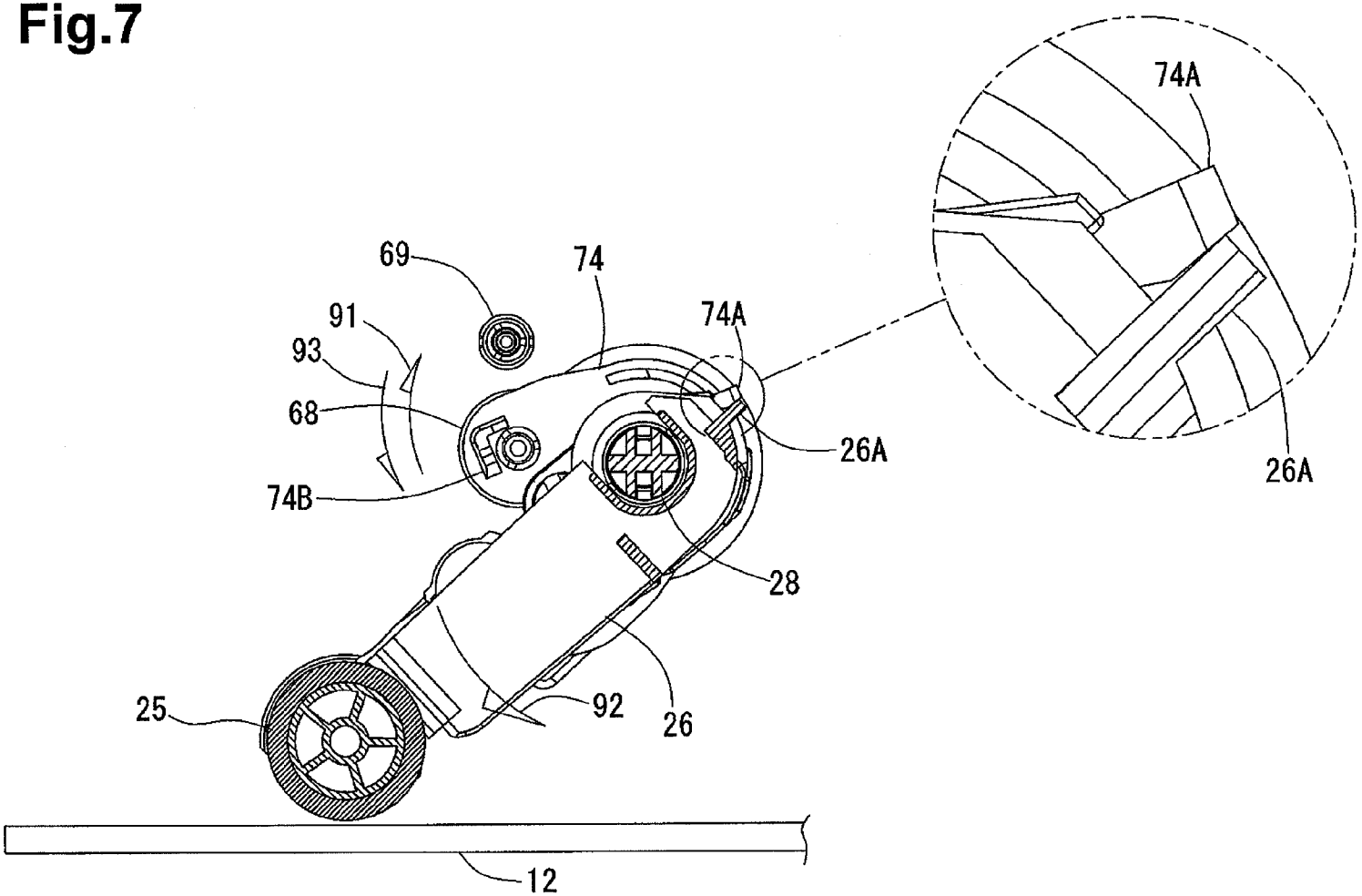
FIG. 7 is a partial cross-sectional view taken along line VI-VI of FIG. 3, showing the feed arm and the convey arm when the tray is removed from the housing.

As shown in FIGS. 6 and 7, each convey arm 74 extends from the shaft 28 substantially rearward. An extending length of each convey arm 74 (a length of each convey arm 74 from the shaft 28 to its free end) is substantially smaller than an extending length of the feed arm 26. In this embodiment, the extending length of each convey arm 74 is approximately a third of the extending length of feed arm 26. One fourth convey roller 68 is rotatably supported by a free end portion of each convey arm 74. The fourth convey rollers 68 are disposed rearward from the shaft 28. In other words, the shaft 28 is disposed on a more front side than the fourth convey rollers 68 (on an opposite side from the fourth convey rollers 68 in the third conveying direction).

In this embodiment, the convey arm 74 is configured to pivot between a third position shown in FIG. 6 and a fourth position shown in FIG. 7. When the convey arm 74 is in the third position, the fourth convey roller 68 is in contact with the corresponding driven roller 69. When the convey arm 74 is in the fourth position, the fourth convey roller 68 is separated below from the corresponding driven roller 69.

As shown in FIG. 5, each convey arm 74 comprises, at an end portion thereof adjacent to the shaft 28, the engaging member 74A configured to engage with the projecting member 26A of the feed arm 26. The engaging member 74A projects from the shaft 28 in a direction away from the fourth convey roller 68. Each engaging member 74 A of the two convey arms 74 projects toward the feed arm 26 such that the engaging member 74A extends over a corresponding one of end portions, in the right-to-left direction 9, of the projecting member 26A.

As shown in FIG. 5, an urging member, e.g., a double torsion spring 54, (referred to simply as "spring" hereafter), which is formed by a metal wire, is attached to the shaft 28. The spring 54 comprises two coil portions 55, and the shaft 28 is inserted into the coil portions 55. The coil portions 55 are spaced apart from each other in an axial direction of the shaft 28. A base end portion of the feed arm 26 is supported by the shaft 28 while being sandwiched by the coil portions 55. A base end portion of each convey arm 74 is supported by the shaft 28 on an outer side, in the right-to-left direction 9, of the corresponding coil portion 55.

The spring 54 comprises leg portions 56 formed at both ends thereof, and a connecting portion 57 that connects the coil portions 55. Each leg portion 56 is engaged with an anchor 74B of a corresponding convey arm 74, and applies a spring force to the convey arm 74 such that the convey arm 74 pivots upward (in a direction of arrow 91 of FIG. 6) about the shaft 28. The connecting portion 57 extends in the right-to-left direction 9 across an upper inclined surface of the feed arm 26 and is engaged with the feed arm 26. The connecting portion 57 applies a spring force to the feed arm 26 such that the feed arm 26 pivots downward (in a direction of arrow 92 of FIG. 6). The spring force of the spring 54 is set to be greater than the self-weights of the convey arm 74 and the fourth convey roller 68. In the state in which the tray 20 is mounted in the printer 11, as shown in FIG. 6, the fourth convey roller 68 is pressed against the driven roller 69 disposed above the fourth convey roller 68 because the spring force acting in the direction of arrow 91 is applied to the convey arm 74. In this state, the feed roller 25 is pressed against the upper surface of the tray 20 or the upper surface of the sheets held on the tray 20 because the spring force acting in the direction of arrow 92 is applied to the feed arm 26.

Referring to FIGS. 6 and 7, movements of the feed arm 26 and the convey arms 74 in response to insertion and withdrawal of the tray 20 will be described.

In this embodiment, as shown in FIG. 6, in the state in which the tray 20 is mounted in the printer 11, the feed arm 26 is maintained in the first position, and the convey arms 74 are maintained in the third position. That is to say, the feed rollers 25 of the feed arm 26 are maintained in contact with the upper surface of the tray 20 or the upper surface of the sheets held on the tray 20, and the fourth convey rollers 68 of the convey arms 74 are maintained in contact with the driven rollers 69, respectively. In this state, as shown in a partial enlarged view in FIG. 6, the projecting member 26A of the feed arm 26 and the engaging member 74A of each convey arm 74 are separated from each other and are not engaged with each other.

As shown in FIG. 7, when the tray 20 is withdrawn from the printer 11 through the opening 13, the feed rollers 25 are not supported by the tray 20 any more. The feed arm 26 pivots in the direction of arrow 92 until the feed arm 26 moves to the second position by a downward force due to its own weight and the spring force of the spring 54 acting in the direction of arrow 92. When the feed arm 26 moves to the second position, the feed rollers 25 contact the upper surface of the bottom plate 12.

When the feed arm 26 pivots in the direction of arrow 92 from the first position to the second position, the projecting member 26A gradually approaches the engaging member 74A of each convey arm 74 and finally contacts the engaging member 74A, as shown in a partial enlarged view in FIG. 7. That is to say, the projecting member 26A and the engaging member 74A engage with each other. When the feed arm 26 pivots further in the direction of arrow 92 while the projecting member 26A and the engaging member 74A are engaged with each other, the projecting member 26A pushes up the engaging member 74A against the spring force of the spring 54 because the spring force is set to be smaller than the self-weights of the feed arm 26 and the feed rollers 25. Thus, a force for pivoting the convey arm 74 in a direction of arrow 93 (opposite to the direction of arrow 91) is applied to the engaging member 74A. After the projecting member 26A and the engaging member 74A engages with each other, the feed arm 26 and each convey arm 74 pivots integrally with each other in the direction of arrow 92.

When the feed arm 26 pivots to the second position, each convey arm 74 moves from the third position to the fourth position. As a result, each fourth convey roller 68 is separated downward from the corresponding driven roller 69.

In the above-described embodiment, the feed arm 26 is in the first position when the tray 20 is mounted in the printer 11. At this time, each convey arm 74 is maintained in the third position because the projecting member 26A and the engaging member 74A are not engaged with each other. When the convey arm 74 is in the third position, the fourth convey roller 68 is in contact with the driven roller 69. When the tray 20 is withdrawn from the printer 11, the feed arm 26 pivots from the first position to the second position. During the pivoting of the feed arm 26, the projecting member 26A and the engaging member 74A engage with each other. After the engagement between the projecting member 26A and the engaging member 74A, the feed arm 26 and each convey arm 74 pivots integrally with each other in the direction of arrow 92. As a result, the convey arm 74 moves from the third position to the fourth position, and the fourth convey roller 68 moves away from the driven roller 69. Thus, even when a sheet is jammed in the return path 67 while being pinched by the fourth convey roller 68 and the driven roller 69, the pinching state by the fourth convey roller 68 and the driven roller 69 is released by removing the tray 20 from the printer 11. This allows the user to readily eliminate the jammed sheet from the return path 67.

When the tray 20 is mounted back into the printer 11, the feed arm 26 moves from the second position to the first position, and each convey arm 74 moves from the fourth position to the third position in response to the movement of the feed arm 26. The convey rollers 70 are brought back into a state for conveying the sheet simply by mounting the tray 20 into the printer 11 after eliminating the jammed sheet from the return path 67.

Although, in the above-described embodiment, the projecting member 26A and the engaging member 74A function as engaging members and configured to engage with each other to move the convey arm from the third position to the fourth position, other engaging structures may be used.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. An image recording device comprising:

a first conveying path along which a sheet is conveyed in a first conveying direction;

a recording unit configured to record an image on the sheet conveyed along the first conveying path;

a tray configured to hold the sheet and to be removably mounted in a housing of the image recording device at a position below the recording unit;

a first driving roller configured to convey the sheet from the tray in a second conveying direction toward the first conveying path;

a first arm having an end to which the first driving roller is rotatably attached, and configured to pivot between a first position and a second position, about a pivot axis located on an opposite side of the first arm from the first driving roller in the second conveying direction, wherein the first arm is in the first position when the tray is mounted in the housing, and is in the second position when the tray is removed from the housing;

a second conveying path formed below the recording unit and above the tray and extending from position downstream of the recording unit in the first conveying direction to a position upstream of the recording unit in the first conveying direction;

a second driving roller configured to convey the sheet along the second conveying path in a third conveying direction; and a second arm having an end to which the second driving roller is rotatably attached, and configured to pivot between a third position and a fourth position, about a pivot axis located on an opposite side of the second arm from the second driving roller in the third conveying direction, wherein the second arm pivots from the third position to the fourth position when the first arm pivots from the first position to the second position, wherein the first arm comprises a first engaging member and the second arm comprises a second engaging member, and when the first arm pivots from the first position to the second position, the first engaging member is configured to engage with the second engaging member such that the second arm pivots from the third position to the fourth position.

2. The image recording device according to claim 1, wherein the first driving roller is in a conveying position on the tray when the first arm is in the first position, and the first driving roller is below the conveying position when the first arm is in the second position, and wherein the second driving roller is in contact with a driven roller disposed along the second conveying path when the second arm is in the third position, and the second driving roller is separated from the driven roller when the second arm is in the fourth position.

3. The image recording device according to claim 2, further comprising an urging member configured to urge the second arm toward such a direction that the second driving roller contacts the driven roller, wherein the second arm pivots from the third position to the fourth position against an urging force of the urging member when the first arm pivots from the first position to the second position.

4. The image recording device according to claim 3, wherein the urging member comprises a torsion coil spring, and one end of the torsion coil spring is attached to the first arm and the other end of the torsion coil spring is attached to the second arm.

5. The image recording device according to claim 3, wherein the urging member has an urging force greater than self-weights of the second arm and the second driving roller.

6. The image recording device according to claim 3, wherein the urging member has an urging force less than self-weights of the first arm and the first driving roller.

7. The image recording device according to claim 1, further comprising a common shaft that defines the pivot axis of the first arm and the pivot axis of the second arm.

8. The image recording device according to claim 1, wherein the first engaging member is disposed on an end portion of the first arm at a position adjacent to the pivot axis of the first arm, and the second engaging member is disposed on an end portion of the second arm at a position adjacent to the pivot axis of the second arm.

9. The image recording device according to claim 1, further comprising:

a third driving roller configured to convey the sheet along the second conveying path in the third conveying direction; and a third arm having an end to which the third driving roller is rotatably attached, and configured to pivot, about a pivot axis located on an opposite side of the third arm from the third driving roller in the third conveying direction, when the first arm pivots between the first position and the second position.

10. The image recording device according to claim 9, further comprising a common shaft that defines the pivot axis of the second arm and the pivot axis of the third arm, and the second arm and the third arm are spaced apart from each other in an axial direction of the common shaft and sandwich the first arm.

11. The image recording device according to claim 2, further comprising:

a common shaft that defines the pivot axis of the first arm and the pivot axis of the second arm; and an urging member configured to urge the second arm toward such a direction that the second driving roller contacts the driven roller.

12. The image recording device according to claim 1, wherein the recording unit comprises nozzles and is configured to eject ink from the nozzles onto the sheet.

* * * * *